US006044775A

United States Patent [19]

Lashlee et al.

[11] Patent Number: 6,044,775

[45] Date of Patent: Apr. 4, 2000

[54] PORTABLE BENCH

[76] Inventors: Maureen Lashlee; Ashton Walton, both of 172 S. French Broad Ave., Asheville, N.C. 28801

[21] Appl. No.: 09/220,529

[22] Filed: Dec. 24, 1998

[51] Int. Cl.[7] ..... A47B 3/00

[52] U.S. Cl. ..... 108/132; 108/133; 108/147.21; 248/188; 248/439

[58] Field of Search ..... 108/116, 117, 108/120, 127, 129, 132, 133, 149.21; 248/188, 439, 292.12

[56] References Cited

U.S. PATENT DOCUMENTS

| | | | |
|---|---|---|---|
| 1,520,589 | 12/1924 | Matkovic | 248/439 |
| 2,556,261 | 6/1951 | Dubach | 108/129 |
| 2,769,650 | 11/1956 | Larson | 248/188 |
| 3,606,450 | 9/1971 | Sedgwick | 108/129 X |
| 3,695,567 | 10/1972 | Weagle | 108/132 X |
| 4,103,626 | 8/1978 | Barricks | 108/127 |
| 4,573,415 | 3/1986 | Ramey | 248/188 X |
| 4,599,988 | 7/1986 | Madurski | 248/439 X |
| 4,645,161 | 2/1987 | Collins | 248/439 |
| 4,735,392 | 4/1988 | Farmer | 108/133 X |
| 5,404,962 | 4/1995 | Carter | 248/439 X |

FOREIGN PATENT DOCUMENTS

| | | | |
|---|---|---|---|
| 1162884 | 8/1969 | United Kingdom | 108/127 |

*Primary Examiner*—Peter M. Cuomo
*Assistant Examiner*—Hanh V. Tran
*Attorney, Agent, or Firm*—Joseph T. Guy, Jr.

[57] ABSTRACT

A folding bench for supporting objects is described. The folding bench comprises a platform with two legs attached to the platform. Each leg comprises a cross member comprising a locating pin and a pin receiver. A first support is attached to the cross member and a second support is attached to the cross member opposite to the first support. The first support and the second support diverge. A bracket attaches each leg to the platform. The bracket comprises a cap wherein the cross member is contained between the cap and the platform. The cap further comprises a locating slot positioned to receive the locating pin wherein the locating pin and the locating slot work in concert to prohibit the legs from moving sideways. A locking mechanism is secured to the cap and reversibly engagable with the pin receiver to prohibit the legs from rotation.

13 Claims, 3 Drawing Sheets

PORTABLE BENCH

BACKGROUND OF THE INVENTION

This invention relates generally to a portable platform which is particularly suitable as a bench, table or the like. Particularly, this invention relates to a portable platform which is easily folded, provides a carrying mechanism when folded and is light in weight.

The number of folding platforms, or benches, on the market are legion in number. Even with this large number the need for a portable, light bench which folds up easily and is convenient to carry is still awaiting a solution. Light weight and strength are contradictory since heavier materials are often required to achieve the strength necessary to hold the necessary weight.

Provided herein is a portable bench which is lightweight, easy to fold and carry, and requires a minimal number of parts which leads to a low cost of manufacture.

SUMMARY OF THE INVENTION

It is an object of the present invention to provide a portable bench which is light weight.

It is another object of the present invention to provide a portable bench which can be easily folded and transported.

A particular feature of the present invention is the low number of parts required which decreases the cost of manufacture.

These and other features, as will be apparent from the description, are provided in a folding bench for supporting objects comprising a platform with two legs attached to the platform. Each said leg comprises a cross member comprising a locating pin and a pin receiver. A first support is attached to the cross member and a second support is attached to the cross member opposite to the first support. The first support and the second support diverge. A bracket attaches each leg to the platform. The bracket comprises a cap wherein the cross member is contained between the cap and the platform. The cap further comprises a locating slot positioned to receive the locating pin wherein the locating pin and the locating slot work in concert to prohibit the legs from moving sideways. A locking mechanism is secured to the cap and reversibly engagable with the pin receiver to prohibit the legs from rotation.

A preferred embodiment is provided in a folding bench for supporting objects. The folding bench comprises a platform. Attached to the platform is a first leg comprising a cross member comprising a locating pin and a pin receiver. A first support terminating at a first terminus is attached to the cross member and a second support terminating at a second terminus is attached to the cross member opposite to the first support. The first support and the second support diverge. Also attached to the platform is a second leg comprising a cross member comprising a locating pin and a pin receiver, a first support terminating at a first terminus is attached to the cross member; and a second support terminating at a second terminus is attached to the cross member opposite to the first support. The first support and the second support diverge. The first terminus of the first leg and the first terminus of the second leg are in close proximity when the folding bench is in a folded position. A pair of brackets attach the first leg to the platform and the second leg to the platform wherein the bracket comprises a cap wherein the cross member is contained between the cap and the platform. The cap further comprises a locating slot positioned to receive the locating pin wherein the locating pin and the locating slot work in concert to prohibit the legs from moving sideways. A locking mechanism is secured to the cap and reversibly engagable with the securing void.

In yet another embodiment is provided a folding bench for supporting objects. The folding bench comprises a platform. Attached to the platform are two legs wherein each leg comprises a cross member comprising a locating pin and a pin receiver. A first support is attached to the cross member; and a second support is attached to the cross member opposite to the first support. The first support and the second support diverge. A bracket attaches each leg to the platform wherein the bracket comprises a cap wherein the cross member is contained between the cap and the platform. The cap further comprises a locating slot positioned to receive the locating pin wherein the locating pin and the locating slot work in concert to prohibit the legs from moving sideways. A locking mechanism is secured to the cap and reversibly engagable with the pin receiver to prohibit the legs from rotation. At least one of the first support or the second support comprises an outer support and an inner support slidably received in the outer support. The inner support comprises a spring loaded pin and the outer support comprises a multiplicity of holes each of which is capable of receiving the spring loaded pin to prohibit sliding of the outer support on the inner support.

DETAILED DESCRIPTION OF THE INVENTION

Throughout the following description similar elements are numbered accordingly.

Figure 1:
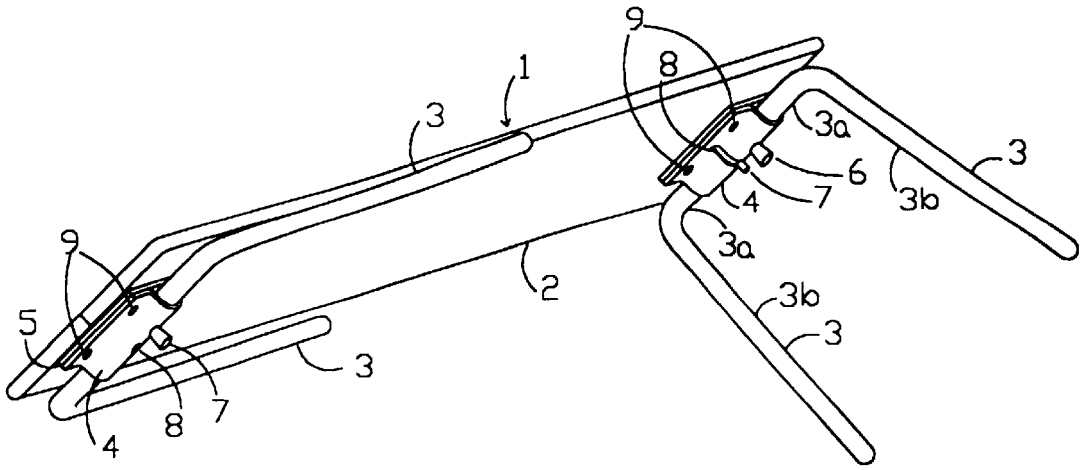
FIG. 1 illustrates an embodiment of the inventive bench with one pair of legs in the folded position and one pair in the extended position.
Figure 2:
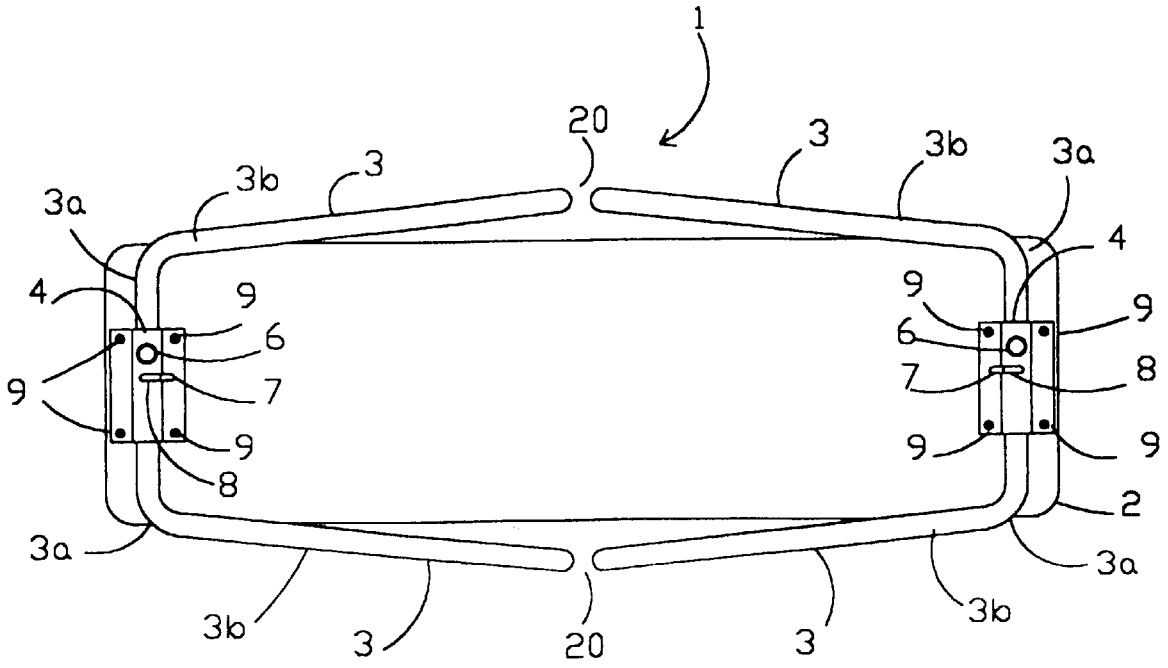
FIG. 2 illustrates an embodiment of the inventive bench folded for transport.

The inventive bench will be described in detail with reference to FIGS. 1 and 2. The bench, generally referred to at 1, comprises a substantially planar platform, 2, which acts as the seat of the bench or the surface upon which items are placed when the bench is in use. The shape of the platform is not limiting, however, rectangular, with optionally rounded corners and edges has been found to be most useful. The platform can be constructed of any material commonly used in the manufacture of furniture with the proviso that the strength must be sufficient to support the intended weight. Preferably, the platform is constructed of molded plastic, metal or laminated wood. Laminated wood has been found to be the best for achieving adequate strength at a reasonable manufacturing cost.

Attached to the bottom of the platform is a pair of supports comprising legs, 3. The legs comprise a cross-member, 3*a,* and supports, 3*b,* which taken together generally form a planar "U". The leg is preferably tubular in design and is preferably manufactured from a single piece of tubing. Other cross-sectional shapes are considered within the teachings of the present invention as is a leg which is manufactured from multiple components joined by welding or the like. The supports, and cross-member are preferably in a planar arrangement with the cross-member being slightly shorter in length than the width of the platform and does not extend beyond the edge of the platform. The supports diverge such that at the terminus the supports are wider than the platform. As seen in FIG. 2 the terminus the diverging supports of the matching legs, come within close proximity thereby forming a handle region, 20, by which the bench can be easily transported. It is most preferred that the matching legs are in contact at the terminus when folded, however, close proximity of no more than approximately 3 inches is acceptable.

A bracket cap, 4, secures the cross-member of the leg to the platform, 2. The bracket cap comprises a raised portion under which the cross-member is contained and a pair of flat portions for securing the bracket cap to the platform. An optional spacer plate, 5, between the bracket cap, 4, and platform, 2, decreases wear on the bottom of the platform and provides smoother rotation of the legs about the axis defined by the cross member. A locking mechanism, 6, the operation of which will be more fully described below, locks the legs in either the folded position or the extended position and prohibit rotation about the axis defined by the cross member. A locating pin, 7, securely fastened to the cross-member, 3*a,* protrudes through a locating slot, 6, in the bracket cap to eliminate sideways movement of the legs along the axis defined by the cross-member. A multiplicity of attachment means, 9, secure the bracket cap, and optional spacer plate to the platform, 2. The attachment means is not limiting but preferred are screws, bolts with nuts, rivets, etc.

Figure 3:
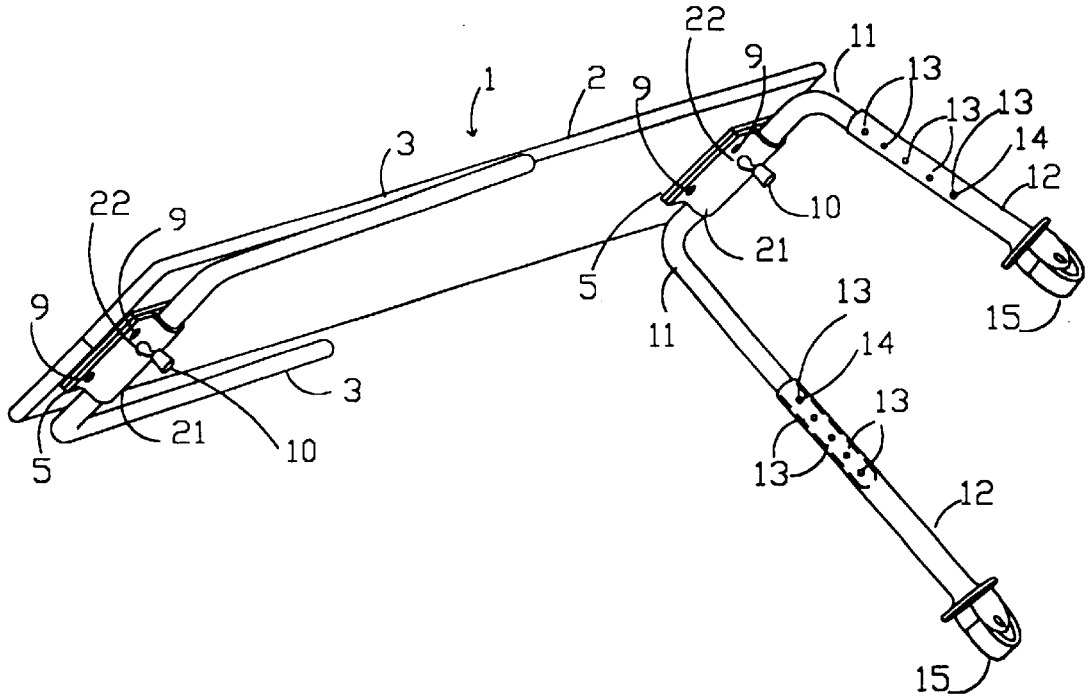
FIG. 3 illustrates a second embodiment of the inventive bench.

FIG. 3 illustrates an additional embodiment of the present invention which is particularly useful on uneven surfaces. In FIG. 3 the platform, 2, a leg, 3, spacer plate, 5, and attachment means, 9, are as described in FIGS. 1 and 2 and will not be described relative to FIG. 3.

In FIG. 3, adjustable legs are provided with an inner leg member, 11, slidably received within an outer leg member, 12. The inner leg member further comprises a spring loaded pin, 14, as known in the art, which reversible engages with one of the multiplicity of holes, 13, in the outer leg member to allow for extension of the leg. It is most preferred that a hole is positioned such that the terminus of the opposing legs form a handle as described in reference to FIG. 2. At the terminus of the outer leg member is an optional wheel, 15, which aids in movement of the bench when in use. It would be readily apparent from the description herein that all legs could be adjustable and all legs could include wheels without departing from the scope of the invention. Wheels with a locking mechanism for unidirectional travel are also contemplated in the present invention.

The bracket cap, 21, comprises a key hole slot, 22, which receives a spring-loaded locking mechanism, 10. When the spring loaded locking mechanism, 10, is withdrawn away from the bracket cap, 21, the larger hole of the key hole slot is disengaged which allows the shaft of the locking mechanism to traverse in the slot which further allows the leg to rotate on the axis defined by the cross-member. The key hole slot and spring-loaded locking mechanism act to prohibit sideways movement of the legs. Spring-loaded locking mechanisms for engaging with a key hole slot are legion in number and commercially available and will not be more fully described herein.

Figure 4:
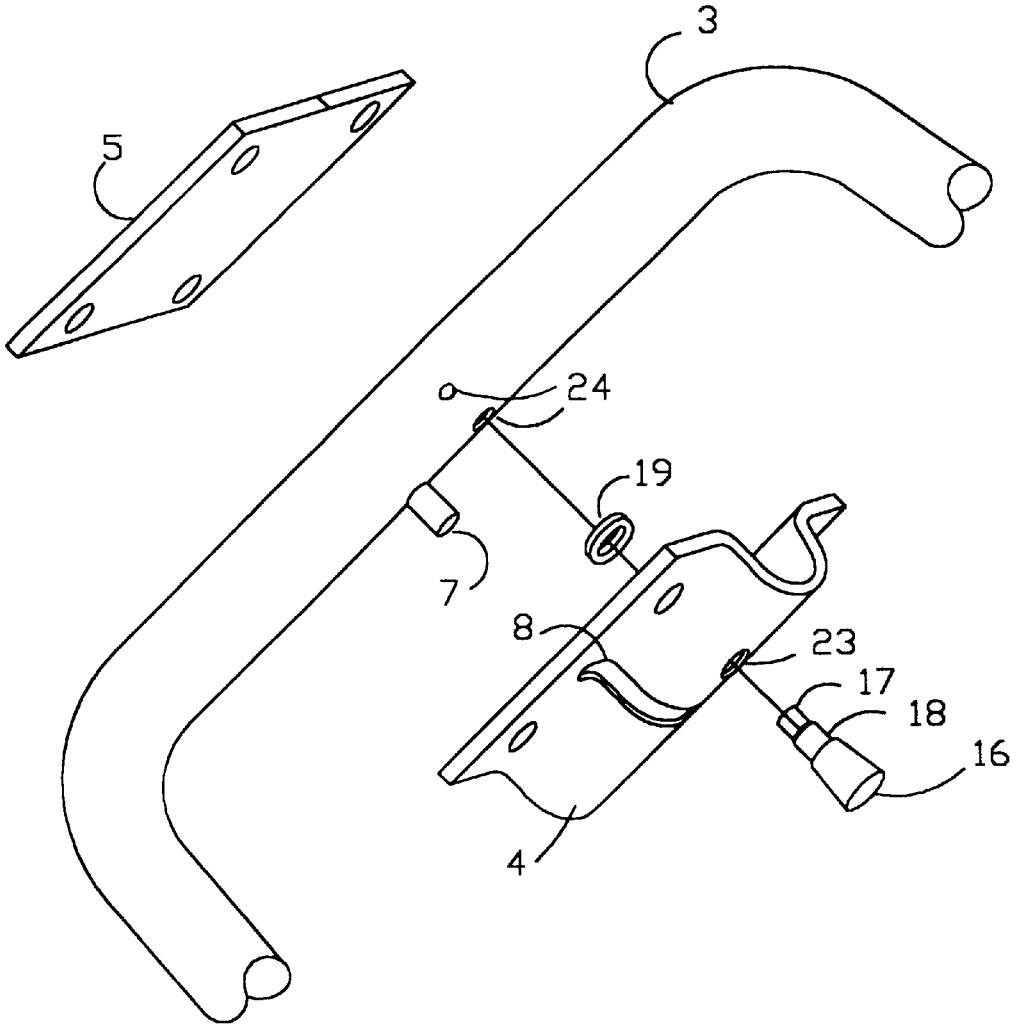
FIG. 4 is an exploded view of the folding mechanism of the inventive device.

FIG. 4 is an exploded view of the folding mechanism of the inventive table. A locating pin, 7, is rigidly attached to the leg, 3, at the cross-member as previously described. The locating pin is received within the locating slot, 8, to insure that the legs do not migrate from side to side. As the legs rotate around the axis defined by the cross-member the pin moves freely within the locating slot perpendicular to the axis of rotation. The bracket cap, 4, further comprises a securing void, 23, suited for rigidly attaching the locking mechanism to the bracket cap by a fastener, 19. The fastener, 19, has threads which mate with threads on a collar, 18, of the locking mechanism. The locking mechanism is more fully understood by referring to FIG. 4 and FIG. 5. The collar, 18, remains stationary relative to the bracket cap. The locking mechanism handle, 16, and locking post, 17, of the locking mechanism move in concert. As the locking mechanism handle, 16, is withdrawn away from the bracket cap, 4, the locking post, 17, is withdrawn from the pin receiver, 24, of the leg, 3. The locking mechanism comprises an internal spring (not shown) which is biased to push the locking post to the extended position. In operation, the locking mechanism handle, 16, would be withdrawn away from the bracket cap, 4, which will withdraw the locking pin, 17, from the pin receiver, 24, thereby allowing the legs to rotate. An optional, but preferred embodiment includes a second pin receiver positioned such that the locking pin, 17, will enter therein to lock the leg in the folded position.

Figure 5:
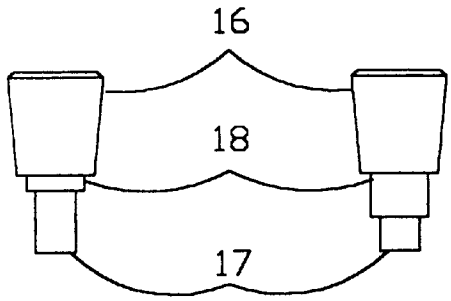
FIG. 5 illustrates the locking mechanism operation.

FIG. 5 illustrates the two extreme positions of the locking mechanism. The locking mechanism handle, 16, and locking pin, 17, move in concert relative to the collar, 18. Locking mechanisms are commercially available and will not be described further herein. Particularly suitable is a spring loaded catch. A particularly preferred spring loaded catch is available from Southco of Concordville, Pa. as part number 56-10-301-20 or 56-10-401-20.

The preferred manner in which the invention can be practiced has been described herein. Other methods for practicing the invention may be realized by those skilled in the art without departing from the spirit of the invention as set forth in the claims.

Claimed is:

1. A folding bench for supporting objects comprising:

a platform;

two legs wherein each said leg comprises:

a cross member comprising a locating pin and a pin receiver;

a first support attached to said cross member; and a second support attached to said cross member opposite to said first support; wherein said first support and said second support diverge;

a bracket for attaching each said leg to said platform wherein said bracket comprises a cap wherein said cross member is contained between said cap and said platform; and said cap further comprises a locating slot positioned to receive said locating pin wherein said locating pin and said locating slot work in concert to prohibit said legs from moving sideways;

a locking mechanism secured to each said cap and reversibly engagable with said pin receiver to prohibit said legs from rotation;

wherein said two legs comprise a first leg and a second leg; and when said bench is folded a first terminus of said first support of said first leg and a second terminus of said first support of said second leg are in close proximity.

2. The folding bench of claim 1 wherein said first terminus and said second terminus are no more than 3 inches.

3. The folding bench of claim 1 wherein said platform is planar.

4. The folding bench of claim 1 wherein said first support, said second support and said cross member are a single piece.

5. The folding bench of claim 1 wherein said first support, said second support and said cross member are attached.

6. The folding bench of claim 1 wherein said cross member is shorter than a width of said platform.

7. The folding bench of claim 1 wherein at least one said leg comprises an outer leg and an inner leg slidably received within said outer leg;

said inner leg further comprises a spring loaded pin and said outer leg further comprises a multiplicity of holes such that said spring loaded pin selectively engages with one of said multiplicity of holes to prohibit sliding of said inner leg in said outer leg.

8. The folding bench of claim 1 further comprising wheels at a terminus of at least on said leg.

9. The folding bench of claim 1 further comprising a spacer plate.

10. The folding bench of claim 1 wherein said cap comprises a raised portion to accommodate said cross member.

11. A folding bench for supporting objects comprising:

a platform;

a first leg comprising:

a first cross member comprising a locating pin and a first pin receiver;

a first support terminating at a first terminus attached to said first cross member; and a second support terminating at a second terminus attached to said first cross member opposite to said first support; wherein said first support and said second support diverge;

a second leg comprising:

a second cross member comprising a second locating pin and a second pin receiver;

a third support terminating at a third terminus attached to said second cross member; and a fourth support terminating at a fourth terminus attached to said second cross member opposite to said third support; wherein said third support and said fourth support diverge; wherein said first terminus of said first leg and said third terminus of said second leg are in close proximity when said folding bench is in a folded position;

a first bracket for attaching said first leg to said platform wherein said first bracket comprises a first cap wherein said first cross member is contained between said first cap and said platform; and said first cap further comprises a locating slot positioned to receive said locating pin wherein said locating pin and said locating slot work in concert to prohibit said first leg from moving sideways;

a second bracket for attaching said second leg to said platform wherein said second bracket comprises a second cap wherein said second cross member is contained between said second cap and said platform; and said second cap further comprises a locating slot positioned to receive said second locating pin wherein said second locating pin and said locating slot work in concert to prohibit said second leg from moving sideways;

a first locking mechanism secured to said first cap and reversibly engagable with said first pin receiver; and a second locking mechanism secured to said second cap and reversibly engagable with said second pin receiver.

12. The folding table of claim 11 wherein said first terminus of said first leg and said first terminus of said second leg are no more than 3 inches apart when said folding bench is in said folded position.

13. A folding bench for supporting objects comprising:

a platform;

two legs wherein each said leg comprises:

a cross member comprising a locating pin and a pin receiver;

a first support attached to said cross member; and a second support attached to said cross member opposite to said first support; wherein said first support and said second support diverge;

a bracket for attaching each said leg to said platform wherein said bracket comprises a cap wherein said cross member is contained between said cap and said platform; and each said cap further comprises a locating slot positioned to receive said locating pin wherein said locating pin and said locating slot work in concert to prohibit said legs from moving sideways;

a locking mechanism secured to each said cap and reversibly engagable with said pin receiver to prohibit said legs from rotation;

wherein at least one of said first support or said second support comprises an outer support and an inner support slidably received in said outer support;

said inner support comprises a spring loaded pin and said outer support comprises a multiplicity of holes each of which is capable of receiving said spring loaded pin to prohibit sliding of said outer support on said inner support.

* * * * *